United States Patent [19]

Northrup et al.

[11] Patent Number: 4,529,912

[45] Date of Patent: Jul. 16, 1985

[54] MECHANISM AND METHOD FOR CONTROLLING THE TEMPERATURE AND LIGHT OUTPUT OF A FLUORESCENT LAMP

[75] Inventors: Karl A. Northrup, Rochester; Thomas J. Hammond, Penfield, both of N.Y.

[73] Assignee: Xerox Corporation, Stamford, Conn.

[21] Appl. No.: 478,748

[22] Filed: Mar. 25, 1983

[51] Int. Cl.[3] ..... H01J 7/24; H01J 13/32; H01J 19/74; H01J 61/52

[52] U.S. Cl. ..... 315/117; 315/115; 315/116; 315/151; 315/158; 250/205

[58] Field of Search ..... 315/112, 113, 114, 115, 315/116, 117, 151, 158; 250/205

[56] References Cited

U.S. PATENT DOCUMENTS

| | | | |
|---|---|---|---|
| 3,284,664 | 11/1966 | Morin et al. | 315/117 X |
| 3,309,565 | 3/1967 | Clark et al. | 315/117 |
| 3,786,308 | 1/1974 | Browner et al. | 315/248 |
| 4,005,332 | 1/1977 | Gallo et al. | 315/112 |
| 4,016,450 | 5/1977 | Balekjian | 315/149 |
| 4,032,817 | 6/1977 | Richmond | 315/149 |
| 4,431,947 | 2/1984 | Ferriss et al. | 315/117 |

*Primary Examiner*—Saxfield Chatmon

[57] ABSTRACT

The phosphor light output of a fluorescent lamp is controlled and optimized. The phosphor light output of the lamp corresponds to a particular level of either the vapor mercury or rare fill gas contained within the lamp envelope. This gas emission level is initially determined for a given system; a monitoring circuit thereafter detects any deviation from this level, generates a signal and sends it to a controller. The controller adjusts the operation of a mercury cold spot temperature-regulating device causing the cold spot temperature to increase or decrease until the optimum temperature and hence lamp phosphor light output is reestablished.

6 Claims, 2 Drawing Figures

MECHANISM AND METHOD FOR CONTROLLING THE TEMPERATURE AND LIGHT OUTPUT OF A FLUORESCENT LAMP

BACKGROUND

This invention relates to mercury vapor fluorescent lamps and particularly to a method for maintaining the mercury pressure, and hence phosphor light output within the lamp at an optimum value by monitoring and controlling the emission of at least one of the gases contributing to the light output.

In a mercury fluorescent lamp, an electrical discharge is generated in a mixture of mercury vapor at low pressure and a fill gas, typically a rare gas such as argon, neon, Krypton, xenon or mixtures thereof. The light output from the lamp depends, among other variables, on the mercury vapor pressure inside the lamp tube. The primary radiation from the mercury is at 2537 Angstroms and arises from the transition between the lowest non-metastable excited state and the ground state. This ultraviolet radiation at 2537 Angstroms excites a phosphor which is coated inside the tube walls. The excited phosphor thereupon emits radiation at some wavelength, in the visible spectrum, characteristic of the phosphor.

It is known in the prior art that the optimum mercury pressure for maximum phosphor light output of a fluorescent lamp is approximately 7 mtorr (independent of current) which corresponds to a mercury cold spot temperature of approximately 40° C. At this temperature and pressure, the light output increases monotonically with the current. At cold spot temperatures higher or lower than the optimum, phosphor, or light output falls off.

It is therefore desirable to maintain the mercury pressure at optimum at any lamp current and at any ambient temperature. Prior art techniques for accomplishing this function required a temperature-sensitive device such as a thermocouple, thermistor or thermostat to monitor the temperature of the cold spot. A feedback circuit provides closed loop control of a temperature-regulating device to maintain the optimum mercury pressure. These methods, although providing a closed loop control of the cold spot temperature, must rely on a consistent relationship of cold spot temperature to mercury density and subsequent light output which may not exist under all conditions.

The present invention is directed to a novel method for maintaining optimum mercury pressure which does not require the use of cold spot temperature measuring devices. As will be demonstrated in the succeeding descriptive portion of the specification, if lamp current is kept constant, the emission of the gas elements contained within the lamp is a function of the mercury cold spot temperature. The phrase "gas elements" is intended to include mercury in its vaporized state as well as the rare fill gases. Specifically, the fill gas emission varies inversely as the cold spot temperature and at a slope of about four times greater than that of the phosphor light output while the mercury line radiation varies directly with the cold spot. According to one aspect of the invention, the particular gas emission is continually monitored by a circuit adapted to feed back a signal to a cold spot temperature-regulating device. The circuit responds to any change in the monitored gas emission by adjusting the operation of the cold spot temperature-regulating device so as to restore the gas emission to its original value. This, in turn, restores the cold spot temperature and hence, phosphor light output to its optimum.

The advantage of this method of output control is that the phosphor light output of the lamp, which is dependent on the cold spot temperature, but which is only a unique function at optimum, can be controlled to optimum without resort to monitoring the cold spot temperature. Also, the sensitivity of particularly the fill gas emission to changes in lamp temperature permits a very accurate feedback system to be implemented as will be demonstrated below.

The present invention is therefore directed to a monitoring and control system for optimizing the phosphor output of a fluorescent lamp containing an excess of mercury at a cold spot therein, said lamp further containing a fill gas therein, said mechanism comprising:

- a power supply for applying operating current to said lamp,
- temperature control means for varying the temperature at said cold spot,
- means for determining an emission level of a gaseous element contained within the lamp which corresponds to the optimum phosphor output of said lamp,
- means for monitoring said emission level to detect changes in said phosphor emission level, said means adapted to generate an output signal in response to a change in said emission level, and
- control means adapted to receive said signals from said emission monitoring means and to regulate the operation of said temperature control means, so as to maintain said cold spot temperature at an optimum level corresponding to optimum phosphor lamp output.

DRAWINGS

DESCRIPTION

Figure 1:
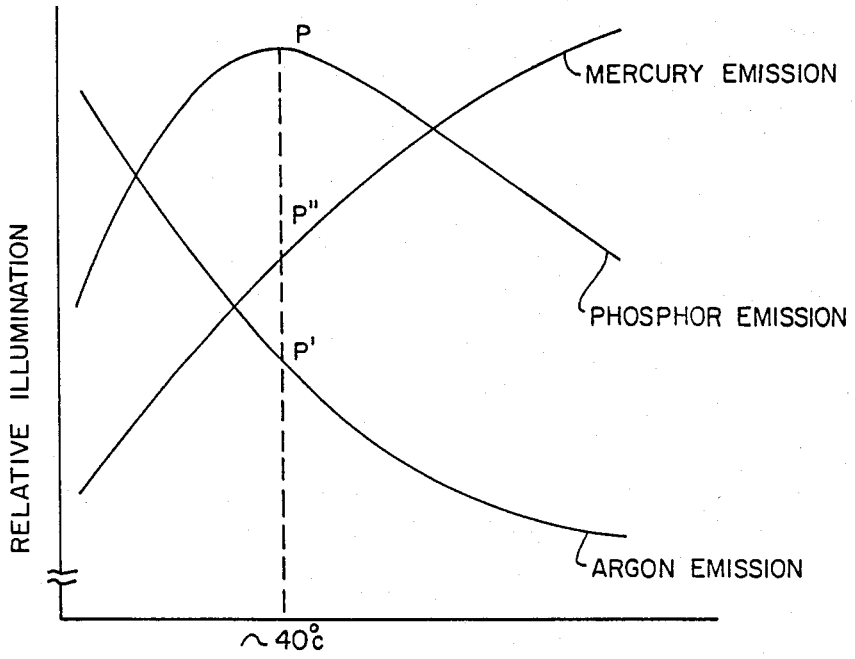
FIG. 1 is a sketch showing phosphor emission, mercury emission and fill gas emission as a function of the cold spot temperature.

FIG. 1 is a graph illustrating the relation between the phosphor light output of a lamp, the fill gas emission (argon in the preferred embodiment) and the mercury vapor emission plotted against cold spot temperature.

As shown, there is a point P on the lamp output plot at which lamp phosphor output is a maximum. Point P corresponds to the optimum mercury pressure of 7 mtorr at approximately 100° F. (40° C.). There is a point P′ on the argon emission plot which corresponds to the peak phosphor light output (P). Finally, there is a point P″ on the mercury emission plot which also corresponds to the peak light output. The argon emission level at point P′, or the mercury emission level at P″ is thus the "correct" reference for maintaining the phosphor light at peak output. By monitoring the argon output or mercury output during lamp operation, and using detected changes from reference points P′ or P″ respectively to adjust the operation of the mercury cold spot temperature-regulating device, an optimum cold spot temperature, and hence light output, can be maintained.

Figure 2:
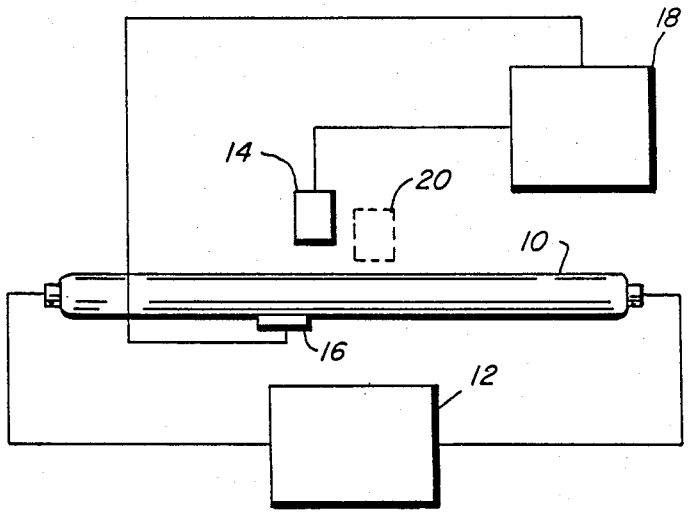
FIG. 2 is a schematic diagram of a circuit including an optical detector and a controller which complements the output control technique of the present invention.

FIG. 2 is a block diagram of a circuit to implement the monitoring and control technique for the argon emissions generally disclosed above. It is noted that a similar circuit would be employed for monitoring and control of the mercury emission. Lamp 10 is a T8, 22 inch fluorescent lamp. The lamp is operated at 1.2 amps with a high frequency (29 Khz) power supply 12. A photodiode detector 14, having a red cut-off filter is placed adjacent the lamp envelope to monitor the argon emission line at 812 nm. A cold spot temperature-regulating device 16 is located at the center of the lamp. Device 16 is a Peltier cooler in a preferred embodiment of the invention. This cooler produces a rectangular cold spot when it is actuated. Controller 18 is a microprocessor-based controller which receives a continuous output signal from detector 14. The controller is programmed to determine the direction of the emission change (e.g. increasing or decreasing, and to control the operation of cooler 16 so as to maintain the cold spot temperature and mercury pressure at optimum.

In operation, the particular system must first be initially calibrated after lamp turn-on. Photodetector 20 shown in dotted form, senses the peak light emission at the center of the lamp and, together with the output of detector 14, establishes the corresponding fill gas emission point P′ in FIG. 1. Once the proper argon emission reference is established, the controller is adjusted to control the lamp output based on changes at reference level P′. Detector 14 then monitors any deviation from the established reference. When the argon emission drops below P′, the signal level from detector 14 to controller 16 is sensed and causes controller 18 to generate an appropriate signal to lower the temperature of cooler 16 and decrease the cold spot temperature. If the argon emission rises above P′, the controller derived signal sent to cooler 16 raises the cooler temperature causing the cold spot temperature to rise. In either case, the cold spot temperature, and hence the phosphor emission is maintained at optimum.

The mercury line would be monitored and controlled in similar fashion by first establishing reference point P″. Because of the differing slope of the mercury line, a rising line would call for an increase in cooling while a falling line would call for a heating increase.

In a test to demonstrate the above regulating techniques, the argon reference emission level was determined to be 812 nm. The emission detector and controller operation was calibrated at this wavelength. It was found that a 30% decrease in argon emission resulted in an approximate 1.5% decrease in phosphor lamp emission. This large ratio of argon emission change to phosphor output change provides one of the advantages of the present method of temperature control. The feedback argon emission signal is extremely sensitive to temperature change, whereas the visible emission has only 1/20 of that sensitivity. The result is an extremely stable control system.

It is noted that the fill gas reference point can vary from lamp to lamp and can change with time as the lamp or the system ages. In these cases, recalibration of the fill gas emission point P′ can be accomplished using the actinic detector 20 in FIG. 2.

The foregoing description of the methods and circuits of the present invention is given by way of illustration and not of limitation. Various other embodiments may be utilized to perform the monitoring and control functions while still within the purview of the invention. For example, instead of a thermoelectric (Peltier's junction) cooler, a cooling fan could be used to control the cold spot temperature in response to signals generated in the emission monitoring circuit. Also, argon emission other than 812 nm can be used to generate the reference signal. Other rare gases and mixtures of rare gases can be used instead of argon and any emission from these rare gases can be used to generate the reference signals. And finally, as already indicated mercury emission could also be used to generate the reference signal.

What is claimed is:

1. A monitoring and control system for optimizing and controlling the phosphor output of a fluorescent lamp containing an excess of mercury at a cold spot therein, said lamp further containing a fill gas therein, said system comprising:

a power supply for applying a constant operating current to said lamp, a temperature control device placed in proximity to said cold spot, said device, when operational, lowering the temperature of the cold spot and, when non-operational, effectively permitting the cold spot temperature to rise, detector means for determining and correlating an emission level of a gaseous element contained within the lamp to an optimum phosphor output of said lamp, a monitoring means for detecting changes in said emission level, said means adapted to generate an output signal in response to a change in said emission level, and a controller circuit adapted to change the operational state of said temperature control above in response to the output signals from said monitoring means so as to maintain said cold spot temperature at an optimum level corresponding to optimum phosphor lamp output.

2. The system of claim 1 wherein said gaseous element is a rare fill gas.

3. The system of claim 1 wherein said gaseous element is vaporized mercury.

4. The mechanism of claim 1, said lamp further including a heater jacket.

5. A method for optimizing the phosphor light output of a fluorescent lamp containing an excess of mercury therein comprising the steps of:

applying operating current to the lamp, determining the optimum phosphor light output emission, said emission corresponding to an optimum mercury cold spot temperature, determining a reference emission level corresponding to at least one of the gas elements contained within the lamp, said emission level corresponding to said optimum lamp emission, monitoring said gas emission level, generating signals representing a change in said monitored gas emission level, and changing the temperature of the mercury cold spot in response to said signals so as to maintain said cold spot temperature at said optimum value.

6. The method of clam 5 including the additional step of periodically redetermining said reference fill gas emission level.

* * * * *